United States Patent [19]

Smock et al.

[11] 4,292,482

[45] Sep. 29, 1981

[54] CIRCUIT CONTROLLER FOR ANTI-WRINKLE CONTROL

[75] Inventors: Steven W. Smock, Indianapolis; George W. Adams, Greenwood, both of Ind.

[73] Assignee: Emhart Industries, Inc., Indianapolis, Ind.

[21] Appl. No.: 99,914

[22] Filed: Dec. 3, 1979

[51] Int. Cl.[3] ..... H01H 43/10

[52] U.S. Cl. ..... 200/38 R; 200/38 B; 200/153 P

[58] Field of Search ..... 200/36, 37 R, 37 A, 200/38 R, 38 A, 38 F, 38 FA, 38 FB, 38 B, 38 BA, 38 C, 38 CA, 38 D, 38 DA, 38 DB, 38 DC, 38 E, 39 R, 39 A, 40, 41, 11 TC, 153 P, 153 PA

[56] References Cited

U.S. PATENT DOCUMENTS

| | | | |
|---|---|---|---|
| 1,931,827 | 10/1933 | Newman | 200/153 P |
| 3,424,876 | 1/1969 | Wiser et al. | 200/38 B |
| 3,818,157 | 6/1974 | Voland et al. | 200/38 BA |

*Primary Examiner*—J. V. Truhe
*Assistant Examiner*—Morris Ginsburg
*Attorney, Agent, or Firm*—Robert F. Meyer; David W. Gomes

[57] ABSTRACT

A circuit controller which in addition to providing a program for actuating functions of a clothes dryer also includes a means to provide an additional program to prevent wrinkling of the clothes after the normal drying program is completed. The additional program is provided in a gear train of a motor and follower means are provided to be actuated by the additional program to open and close electrical switches.

7 Claims, 3 Drawing Figures

CIRCUIT CONTROLLER FOR ANTI-WRINKLE CONTROL

BACKGROUND OF THE INVENTION

Generally speaking, the present invention pertains to a circuit controller which actuates machine functions of an appliance; a motor and a gear train driving the controller, the gear train including a program means; follower means engaging the program means to be actuated thereby; and electrical switch means responsive to the follower means to be opened and closed thereby.

This invention relates, in general, to a timing mechanism and in particular to a timing mechanism particularly adaptable for controlling a laundry dryer through a timed fabric treatment cycle.

Some automatic clothes dryers include an anti-wrinkle control system that provides for rearranging and refluffing permanent press fabrics every few minuts if they are not removed from the dryer at the end of the automatic or timed drying period. More specifically, at the end of a permanent press cycle, a buzzer sounds to remind a housewife, for example, that her clothes are ready. If she is busy or out of the home, the anti-wrinkle control starts the dryer at predetermined intervals, for example every five minutes and tumbles the clothes for a predetermined interval, for example, 10 seconds. At the end of each 10 seconds of tumbling, the dryer again buzzes to remind the housewife to remove the clothes. The dryer continues to "nag" in this manner for a predetermined period of time, for example, up to two and one half hours. However, for the times illustrated, total running time for the dryer would only be five minutes.

One system providing an anti-wrinkle portion of a drying cycle employed two timer motors. One motor drove the timer cams which sequentially operated the dryer at a constant speed, while a second "pulser" motor drove a cam to intermittently complete a circuit to the timer motor to advance the timer cams intermittently and to complete a circuit and intermittently cycle the main dryer motor operating the dryer and to run out the timer motor until a predetermined accumulative minutes of timer "on time" had expired. A "two motor" timer useful for such a system is described in U.S. Pat. No. 3,732,383 issued May 8, 1973. Because of the decreasing amount of available space required in automatic clothes dryer operation and because of the increased amount of cost of the additional motor, it has become highly desirable to replace this conventional method of operation with a system utilizing only the single timer motor.

In another system, two cams are carried by a shaft, one of them being fixed to the shaft and the other being freely rotatable about the shaft. A gear train of a motor drive means is supplied with two separate output pinions, the two output pinions serving to simultaneously drive the two cams at different speeds. The faster speed can be used to provide selective pulsing which can be used in anti-wrinkle control. While this system has been used satisfactorily, it has been found to be somewhat expensive for certain applications.

FEATURES OR OBJECTS OF THE INVENTION

The present invention, therefore, is concerned with a controller which is particularly adaptable to the operation of an automatic clothes dryer having an anti-wrinkle control system and has as one of its features the provision of a controller which is neat, compact, and relatively low in cost. Another feature of the invention is the provision of a controller which is driven by a motor drive means which includes a gear train, and wherein the gear train includes a program in addition to that of the controller. Another feature of the invention is the provision of such a controller wherein a follower means engages the additional program means to be actuated to open and close electrical switches. Still another feature of the invention is the provision of such a controller wherein locator means places the switch means into an operable position with this follower means. Yet another feature of the invention is the provision of such a controller wherein the program means includes a gear of the gear train. Another feature of the invention is the provision of such a controller wherein the gear is an output pinion of the gear train. These and other features of the invention will become apparent from the following description taken in conjunction with the accompanying drawings.

DETAILED DESCRIPTION OF THE INVENTION

Figure 1:
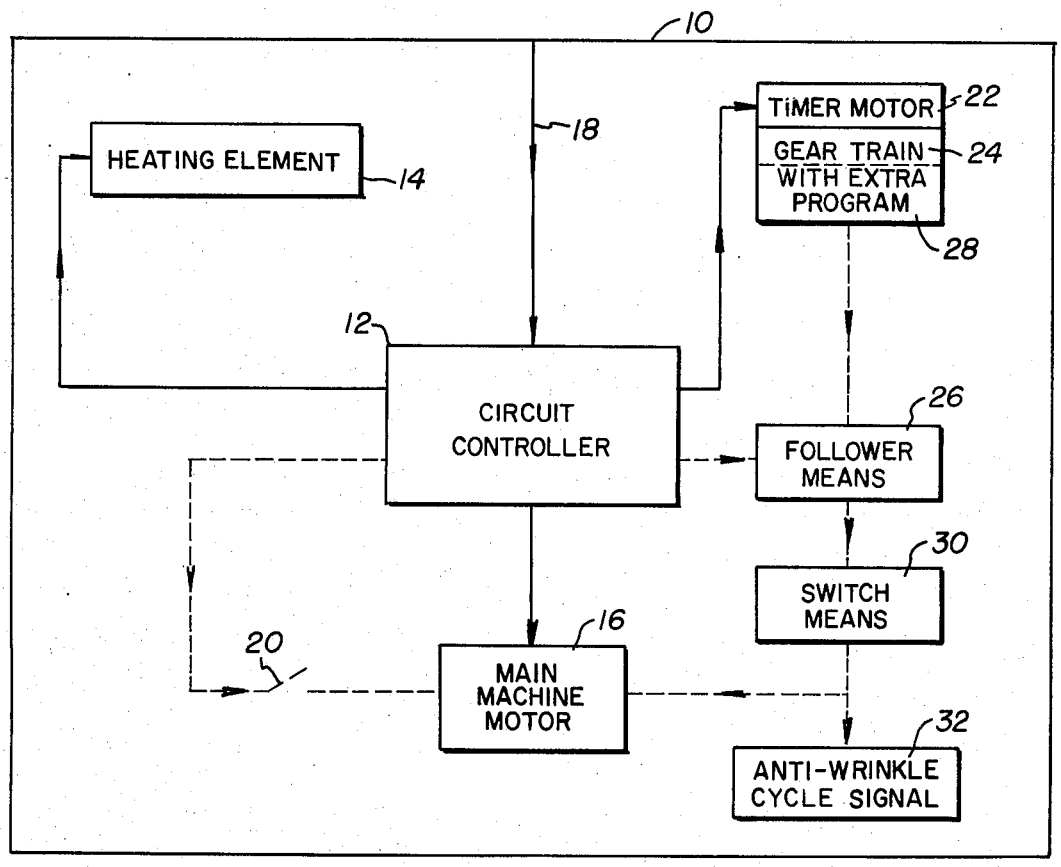
FIG. 1 is a block diagram illustrating the relationship of a controller, having the features of the invention, in relation to an appliance.

Referring to FIG. 1, an appliance 10 is illustrated using a circuit controller 12 to control the various functions of the appliance. In the illustrative embodiment, the appliance is a clothes dryer having a heating element 14 and a main machine motor 16 which operates a tumbler (not shown) for tumbling clothes while heat is applied from heating element 14. Electrical power is applied to controller 12 as indicated by arrows 18. When electrical power is applied, momentary switch 20 is momentarily closed to complete a circuit to the main machine motor 16 and to timer or controller motor 22 to begin driving the controller. Movement or rotation of circuit controller 12 controls the time duration of the functions of heating element 14, machine motor 16 and continued rotation of timer motor 22 along with gear train 24 coupled to the motor.

As will be hereinafter described, controller 12 places a follower means 26 into an operable position with respect to an extra program 28 included in the gear train 24. Actuation of follower means 26 closes a switch means 30 in short pulses to operate the main machine motor 16 in short pulses to tumble the clothes in short pulses and at the same time sound a signal 32 to indicate to a housewife that the normal drying cycle has been completed and that an anti-wrinkle cycle is operating.

Figure 3:
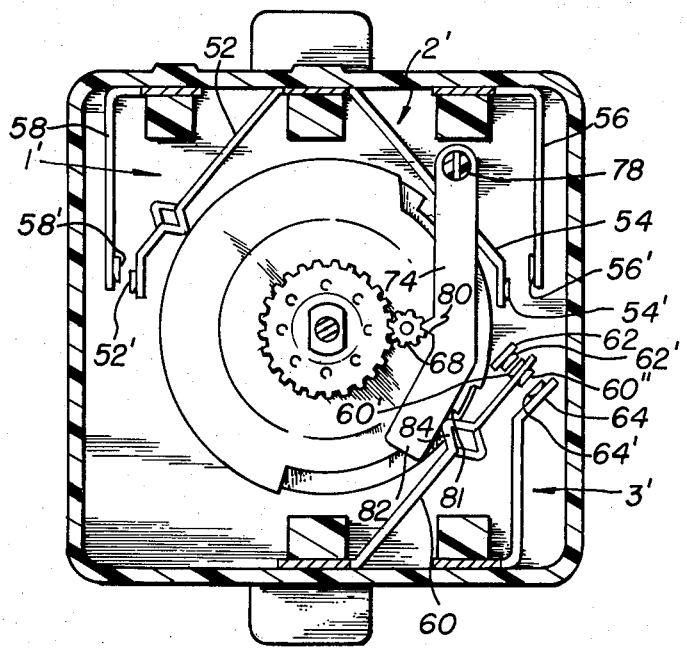
FIG. 3 is a section taken along the line 3—3 of FIG. 2.
Figure 2:
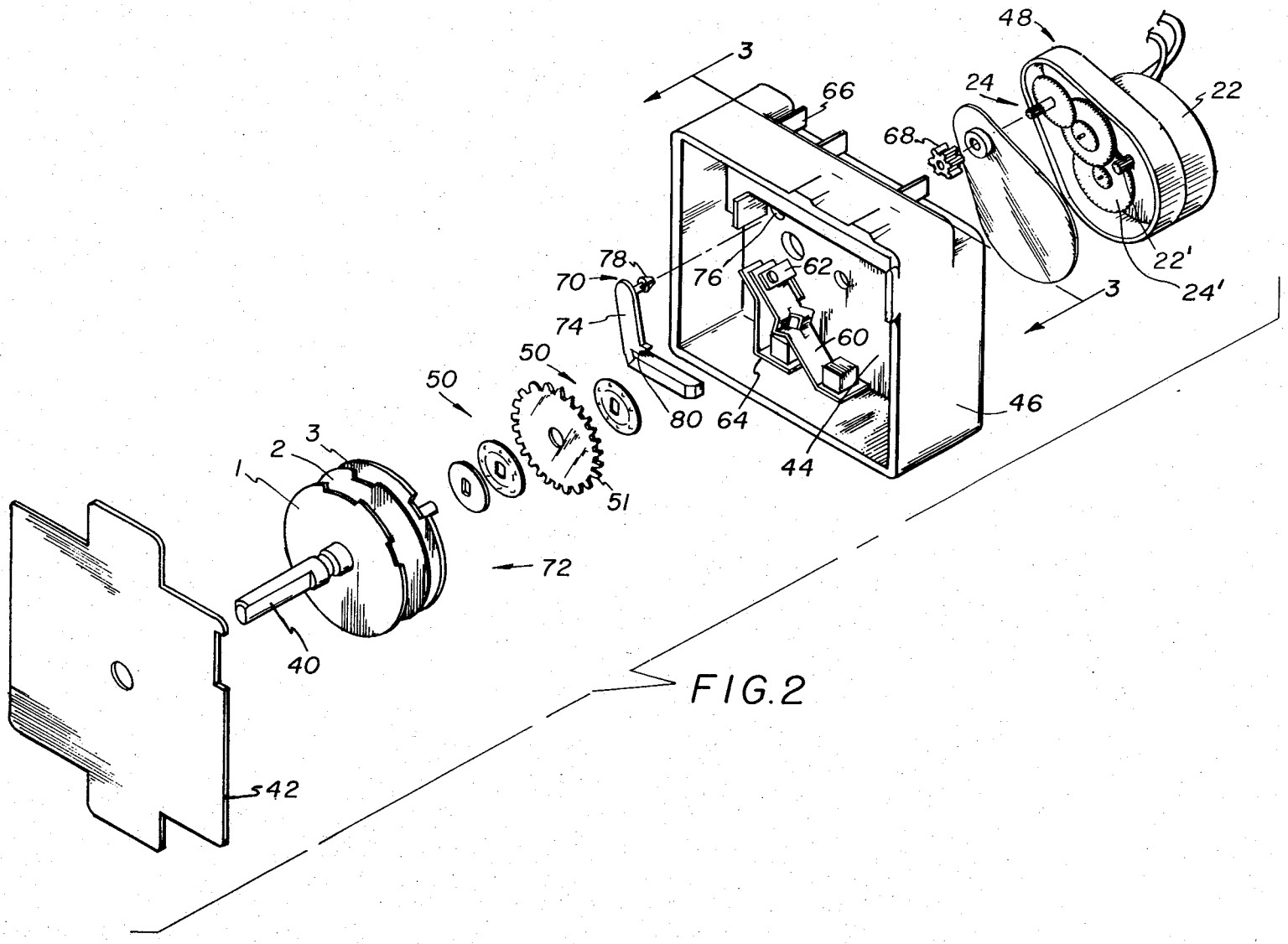
FIG. 2 is an exploded view of the controller of the invention.

Referring now to FIGS. 2 and 3, a detailed illustration of controller 12 is shown. Controller 12, in general, includes a plurality of cams 1—3 carried on a cam shaft which is journalled for rotation in end plate 42 and the base 44 of cup shaped housing 46, and a plurality of electrical switch means 1'–3' which engage the cams to be actuated thereby. The cams are rotated by a motor drive means 48 through a clutch means 50 and gear 51 which is engaged by the clutch means, gear 51 being fixedly carried on shaft 40 to cause rotation thereof. Cluch means 50 permits manual rotation of the shaft independent of the motor drive means.

Switch means 1' and 2' are single pole switches each with a movable blade 52 and 54, fixed blades 56 and 58, with each blade having mating electrical contacts 52', 58' and 54', 56'. Switch means 3' is of a double throw type having a movable blade 60 and fixed blades 62 and 64 and cooperating electrical contacts 60', 62' and 60'', 64'. Electrical paths to the appliance functions are made from the switch means through corresponding electrical terminals 66.

Motor drive means 48 includes timer motor 22 having an output pinion 22' and a gear train 24 which includes a series of gears and pinions 24' coupled between motor output pinion 22' and gear train output pinion 68. Output pinion 68 meshes with gear 51 to cause rotation of the gear and shaft 40. Rotation of shaft 40 causes rotation of cams 1—3 to open and close the corresponding switch means 1'—3' to control the functions of the appliance in accordance with a program provided by the cams.

In accordance with the present invention, an extra program of short pulses is made available within gear train 24 for short pulsing of the machine motor 16 to pulse the dryer tumbler. In the present embodiment, the extra program is provided by gear train output pinion 68 with its teeth serving as individual cams and the program being determined by the number of teeth of the pinion and the speed of its rotation. In order to transmit the extra program to the machine motor 16, there is provided a follower means 70 and a locator means 72 which moves or otherwise places switch means into position to be actuated by the follower means. Follower means 70 includes an arm 74 which is pivotly mounted in aperture 76 (FIG. 2) through pin 78. Arm 74 carries a V-shaped cam follower 80 which engages the teeth of output pinion 68 to be actuated in accordance with the cam surfaces provided by the teeth. Locator means includes cam 3. More specifically a step 81 (FIG. 3) of cam 3 drops contact blade 60 from a neutral position, as shown, to bottom contact 62'. Then as arm 74 is pulsed through the cam surfaces provided by the teeth of output pinion 68, the end portion of arm 82 pulses blade 60 through follower 84 to make and break contacts 60' and 62' to provide the pulsing action.

In operation, as the dryer comes to the end of its drying cycle, step 81 of cam 3 drops contact blade 60 to drop contact 60' into engagement with contact 62' and into position to be actuated by arm 74. Contacts 60' and 62' are then pulsed to provide a pulsing action to machine motor 16 (FIG. 1) and in addition provides a pulse to signal 32 which may be any suitable type of buzzer. Such pulsing continues until the housewife removes power from the appliance.

What is claimed is:

1. In an apparatus wherein a cam means is rotatably driven by a motor drive means and wherein first electrical switch means is responsive to said cam means to be opened and closed in accordance with a program of said cam means, means providing an extra program of short switching pulses, comprising:

(a) a gear train coupled between said motor drive means and said cam means, said gear train including program means providing said extra program, (b) follower means engaging said program means to be actuated in accordance with said extra program, (c) second electrical switch means responsive to said follower means to be opened and closed thereby, and (d) locator means engaging said second electrical switch means to selectively position same into and out of an operable position with said follower means.

2. In an apparatus according to claim 1 wherein said first electrical switch means includes an electrical contact of a double throw switch, said second electrical switch means includes another electrical contact of said double throw switch, and said locator means includes said cam means.

3. In an apparatus according to claim 1 wherein said program means includes a gear of said gear train.

4. In an apparatus according to claim 3 wherein said gear is a pinion.

5. In an apparatus according to claim 3 wherein said gear is an output member of said gear train.

6. In an apparatus according to claim 1 wherein said follower means includes a pivotally mounted pawl having a cam follower thereon engaging said program means, a distal end of said pawl engaging said second electrical switch means.

7. In an appliance:

(a) a circuit controller actuating machine functions including a main machine motor of said appliance in accordance with a first program, (b) a motor and gear train coupled thereto driving said circuit controller, said gear train including a second program means, (c) follower means engaging said second program means to be actuated thereby, (d) electrical switch means responsive to said follower means to be opened and closed thereby to selectively energize and deenergize said machine motor in short pulses, and (e) locator means engaging said electrical switch means to selectively position same into and out of an operable position with said follower means.

* * * * *